US012098642B2

(12) United States Patent
Forni

(10) Patent No.: US 12,098,642 B2
(45) Date of Patent: Sep. 24, 2024

(54) DOUBLE SIDED OIL FILM THRUST BEARING IN A SCROLL PUMP

(71) Applicant: Agilent Technologies, Inc., Santa Clara, CA (US)

(72) Inventor: Ronald J. Forni, Lexington, MA (US)

(73) Assignee: Agilent Technologies, Inc., Santa Clara, CA (US)

( * ) Notice: Subject to any disclaimer, the term of this patent is extended or adjusted under 35 U.S.C. 154(b) by 355 days.

(21) Appl. No.: 17/607,363

(22) PCT Filed: Apr. 30, 2019

(86) PCT No.: PCT/US2019/030044
§ 371 (c)(1),
(2) Date: Oct. 28, 2021

(87) PCT Pub. No.: WO2020/222827
PCT Pub. Date: Nov. 5, 2020

(65) Prior Publication Data

US 2022/0220852 A1 Jul. 14, 2022

(51) Int. Cl.
*F01C 21/02* (2006.01)
*F01C 21/04* (2006.01)
(Continued)

(52) U.S. Cl.
CPC ..... *F01C 21/02* (2013.01); *F04C 18/0215* (2013.01); *F04C 27/005* (2013.01); *F04C 29/02* (2013.01); *F04C 2240/54* (2013.01)

(58) Field of Classification Search
CPC ..... F01C 21/02; F01C 21/04; F04C 18/0215; F04C 27/005; F04C 29/02
See application file for complete search history.

(56) References Cited

U.S. PATENT DOCUMENTS 4,065,279 A 12/1977 Mccullough
5,338,159 A 8/1994 Riffe et al.
(Continued)

FOREIGN PATENT DOCUMENTS

CN 101205908 A 6/2008
CN 102817841 A 12/2012
(Continued)

OTHER PUBLICATIONS

English JP 2753317 by PE2E May 25, 2023.*
(Continued)

*Primary Examiner* — Deming Wan

(57) ABSTRACT

A vacuum scroll pump having an inlet portion having a pump inlet, and an exhaust portion having a pump outlet; a frame; a stationary scroll plate fixed to the frame and comprising a stationary plate comprising at least one stationary scroll blade; an orbiting scroll plate comprising an orbiting plate comprising at least one orbiting scroll blade projecting axially from a front side of the orbiting plate toward the stationary plate; a drive mechanism supported by the frame and operatively connected to the orbiting scroll plate so as to cause the orbiting scroll plate to orbit about a longitudinal axis of the vacuum scroll pump and thereby pump a process gas; a double-sided thrust bearing supporting the orbiting scroll plate; and a bellows which isolates the process gas from the drive mechanism.

19 Claims, 7 Drawing Sheets

(51) Int. Cl.

| | |
|---|---|
| ***F04C 18/02*** | (2006.01) |
| ***F04C 27/00*** | (2006.01) |
| ***F04C 29/02*** | (2006.01) |

(56) References Cited

U.S. PATENT DOCUMENTS

| | | | | |
|---|---|---|---|---|
| 7,442,016 | B2 | 10/2008 | Dovey et al. | |
| 7,878,777 | B2 | 2/2011 | Iwanami et al. | |
| 8,747,088 | B2 | 6/2014 | Elson et al. | |
| 9,353,747 | B2 | 5/2016 | Ito et al. | |
| 9,605,674 | B2 | 3/2017 | Forni et al. | |
| 9,879,673 | B2 | 1/2018 | Su et al. | |
| 11,047,389 | B2 * | 6/2021 | Shaffer | F04C 29/0085 |
| 2001/0012489 | A1 | 8/2001 | Harakawa et al. | |
| 2005/0084403 | A1 | 4/2005 | Liepert et al. | |
| 2014/0140877 | A1 | 5/2014 | Ni | |
| 2014/0154116 | A1 | 6/2014 | Ishizono et al. | |
| 2014/0271305 | A1 | 9/2014 | Forni et al. | |
| 2015/0159650 | A1 * | 6/2015 | Forni | F04C 29/0057 418/55.1 |
| 2016/0348679 | A1 | 12/2016 | Forni et al. | |
| 2016/0356273 | A1 | 12/2016 | Calhoun et al. | |
| 2018/0021850 | A1 | 1/2018 | Ruxanda et al. | |

FOREIGN PATENT DOCUMENTS

| | | | | |
|---|---|---|---|---|
| CN | 109312744 | A | 2/2019 | |
| IN | 201101206 | I3 | 8/2011 | |
| JP | H02245488 | A | 10/1990 | |
| JP | H07180674 | A | 7/1995 | |
| JP | 2753317 | B2 * | 5/1998 | |
| JP | 2006308004 | A | 11/2006 | |
| KR | 101275181 | B1 | 6/2013 | |
| WO | WO-2012167611 | A1 * | 12/2012 | F04C 18/0215 |
| WO | 2016127470 | A1 | 8/2016 | |

OTHER PUBLICATIONS

English WO-2012167611 by PE2E May 25, 2023.*

Epo, et al., Extended European Search Report mailed on Nov. 14, 2022 for Application No. 19926808.7; 10 pages.

International Search Report and Written Opinion mailed on Jan. 23, 2020 for Application No. PCT/US2019/030044; 11 pages.

Chinese Office Action and Search Report dated Feb. 25, 2023 for Application No. 201980095722.0; 7 pages.

* cited by examiner

DOUBLE SIDED OIL FILM THRUST BEARING IN A SCROLL PUMP

RELATED APPLICATIONS

This application is the national stage under 35 U.S.C. 371 of International Application No. PCT/US2019/030044, filed Apr. 30, 2019; the entire contents of which are incorporated by reference herein.

TECHNICAL FIELD

The present invention relates to scroll vacuum or pressure pumps and a bearing support for an orbiting scroll plate utilized in the scroll pumps.

BACKGROUND

A conventional scroll pump is a type of pump that includes a stationary plate scroll having one or more spiral stationary scroll blades, an orbiting plate scroll having one or more spiral orbiting scroll blades, and an eccentric driving mechanism to which the orbiting plate scroll is coupled. In the scroll pump, the stationary plate scroll and the orbiting plate scroll are engaged with each other, thereby forming at least one pumping chamber(s) in between. As the pumping chamber(s) moves away from the inlet toward the outlet in association with orbiting of the movable scroll, the volume of the pumping chamber closest to the inlet is gradually increased. Vacuum is generated in the course of increasing the volume of this pumping chamber.

The stationary and orbiting scroll blades are nested with a radial clearance and predetermined relative angular positioning such that a series of pockets are simultaneously defined by and between the blades. The orbiting plate scroll (and hence the orbiting scroll blade) is driven by the eccentric driving mechanism to orbit relative to the stationary plate scroll about a longitudinal axis of the pump passing through the axial center of the stationary scroll blade. See "L" labeled on FIG. 1. As a result, the volumes of the pockets delimited by the scroll blades of the pump are varied as the orbiting scroll blade moves relative to the stationary scroll blade. The orbiting motion of the orbiting scroll blade also causes the pockets to move within the pump head assembly such that the pockets are selectively placed in open communication with an inlet and outlet of the scroll pump.

In a vacuum scroll pump, the motion of the orbiting scroll blade relative to the stationary scroll blade causes a pocket sealed off from the outlet of the pump and in open communication with the inlet of the pump to expand. Accordingly, fluid is drawn into the pocket through the inlet. The inlet of the pump is connected to a system that is to be evacuated, e.g., a system including a processing chamber in which a vacuum is to be created and/or from which gas is to be discharged. Then the pocket is moved to a position at which it is sealed off from the inlet of the pump and is in open communication with the outlet of the pump, and at the same time the pocket is contracted. Thus, the fluid in the pocket is compressed and thereby discharged through the outlet of the pump.

Prior art vacuum scroll pumps typically have an inlet portion having a pump inlet, an exhaust portion having a pump outlet, a frame, a stationary plate scroll fixed to the frame, and an orbiting plate scroll whose scroll blade(s) is nested with that of the stationary plate scroll to define a series of pockets constituting a compression stage. An eccentric drive mechanism supported by the frame and operatively connected to the orbiting plate scroll has been used to drive the orbiting plate scroll in an orbit about a longitudinal axis of the pump. This eccentric drive mechanism often includes a crankshaft and spring-loaded angular contact bearings disposed on the crankshaft, a tubular bellows extending around the eccentric drive mechanism and having a first end connected to the orbiting plate and a second end connected to the frame, and counterbalancing features attached to the crankshaft by which radial loads produced on the eccentric drive mechanism are offset.

U.S. Pat. No. 9,605,674 (the entire contents of which are incorporated herein by reference) describes one type of scroll pump with an eccentric drive mechanism and bearings disposed on the crankshaft.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, a vacuum scroll pump has an inlet portion having a pump inlet, and an exhaust portion having a pump outlet; a frame; a stationary scroll plate fixed to the frame and comprising a stationary plate comprising one or more stationary scroll blade(s), wherein the stationary scroll blade(s) has the form of a spiral emanating from a central portion of the stationary plate; an orbiting scroll plate comprising an orbiting plate comprising one or more orbiting scroll blade(s) projecting axially from a front side of the orbiting plate toward the stationary plate, wherein the orbiting scroll blade has the form of a spiral emanating from a central portion of the orbiting plate, and wherein the stationary scroll blade(s) and the orbiting scroll blade(s) are nested such that pockets are delimited by and between the stationary scroll blade and the orbiting scroll blade; a drive mechanism supported by the frame and operatively connected to the orbiting scroll plate so as to cause the orbiting scroll plate to orbit about a longitudinal axis of the vacuum scroll pump and thereby pump a process gas; a double-sided thrust bearing supporting the orbiting scroll plate scroll; and a bellows which isolates the process gas from the drive mechanism.

According to another embodiment, a double-sided thrust bearing for supporting an orbiting scroll plate in a vacuum scroll pump includes a first orbiting thrust bearing configured to connect to the orbiting scroll plate, a stationary double-sided thrust bearing on which the first orbiting thrust bearing orbits during motion of the orbiting scroll plate, a second orbiting thrust bearing coupled to the orbiting thrust bearing, and a lubricating film maintained on both sides of the stationary double-sided thrust bearing contacting the first orbiting thrust bearing and the second orbiting thrust bearing.

According to another embodiment, a system includes the aforementioned vacuum scroll pump with its double-sided thrust bearing.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
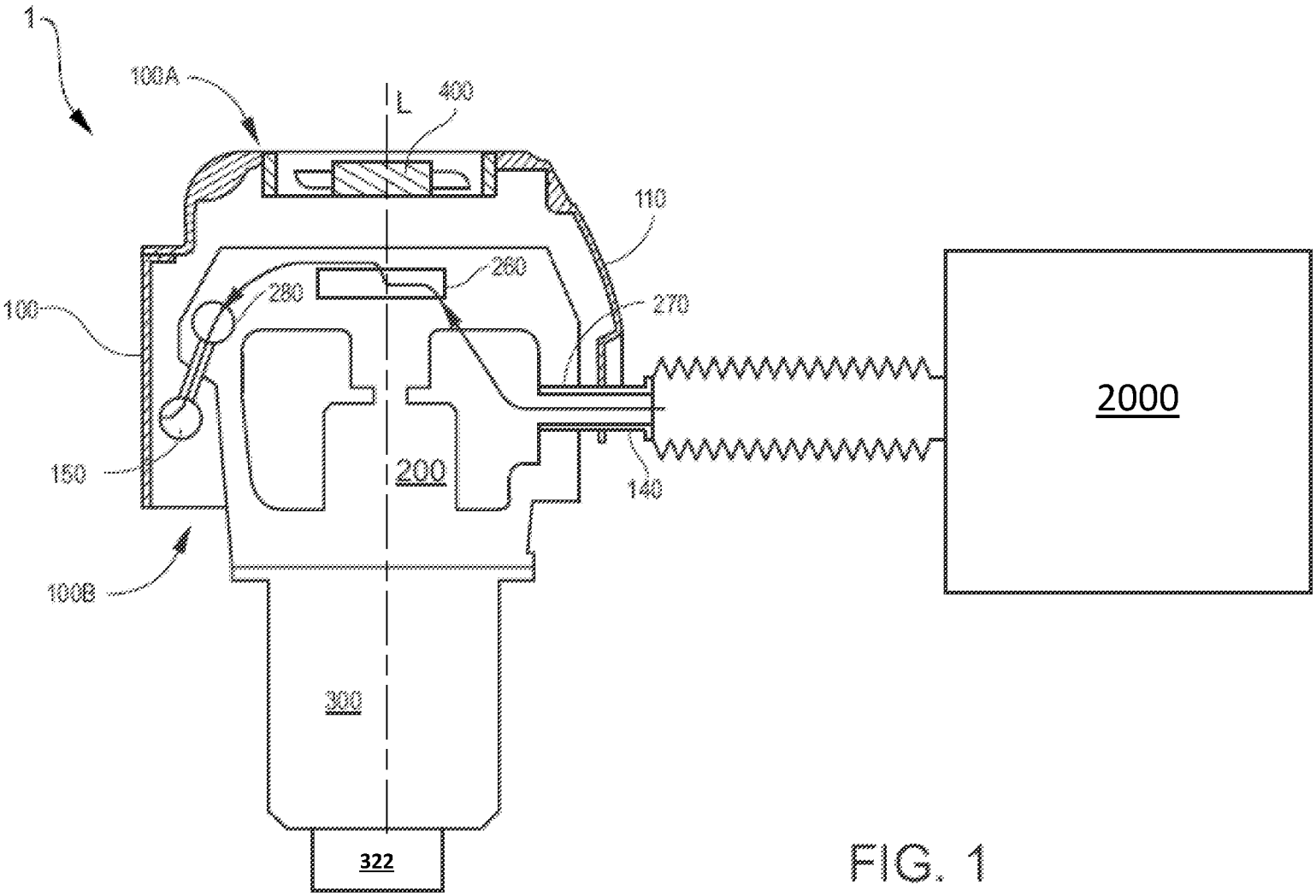
FIG. 1 is a schematic of a scroll pump to which the present invention may be applied.

Various embodiments and examples of embodiments of the invention will be described more fully hereinafter with reference to the accompanying drawings. In the drawings, the sizes and relative sizes of elements may be exaggerated for clarity. Likewise, the shapes of elements may be exaggerated and/or simplified for clarity and elements may be shown schematically for ease of understanding. Also, like numerals and reference characters are used to designate like elements throughout the drawings.

Other terminology used herein for the purpose of describing particular examples or embodiments of the invention is to be taken in context. For example, the term "comprises" or "comprising" when used in this specification indicates the presence of stated features or processes but does not preclude the presence of additional features or processes. Terms such as "fixed" may be used to describe a direct connection of two parts/elements to one another in such a way that the parts/elements cannot move relative to one another or an indirect connection of the parts/elements through the intermediary of one or more additional parts. Likewise, the term "coupled" may refer to a direct or indirect coupling of two parts/elements to one another. The term "delimit" is understood to mean provide a boundary. The term "spiral" as used to describe a scroll blade is used in its most general sense and may refer to any of the various forms of scroll blades known in the art as having a number of turns or "wraps."

Terminology related to rotational and orbital motions used herein refers to the manner in which the drive mechanisms and the orbiting scroll plate move. The term "rotate" or "rotation" or other derivatives thereof refers to the turning of a shaft which is driven by the motor where for example, if the shaft had its longitudinal direction defining the z-axis of an x-y-z system whose origin is on the center of the shaft, then rotation of the shaft would spin the shaft around the longitudinal axis or z-axis with the x- and y-directions constantly changing their pointing directions. When the shaft is rotating, any deviation of the pointing direction of the z-axis or any deviation of the location of the z-axis intersection to the x-y plane is referred to herein as a movement away from the longitudinal direction of the shaft. The term "orbit" or "orbital" or derivatives thereof refers to the eccentric movement of for example an orbiting scroll plate where, if the orbiting scroll plate is defined by the x-y plane of an x-y-z system, then the orbital motion of the orbiting scroll plate would produce no change in any of the x-, y-, and z-pointing directions.

Referring to FIG. 1, a vacuum scroll pump 1 to which the present invention can be applied may include a cowling 100, and a pump head assembly 200 having an inlet opening 270 and an exhaust opening 280, a pump motor 300, and a cooling fan 400 disposed in the cowling 100. Furthermore, the cowling 100 defines an air inlet 100A and an air outlet 100B at opposite ends thereof, respectively. The cowling 100 may also include a cover 110 that covers the pump head assembly 200 and pump motor 300. The cover 110 may be of one or more parts.

As seen in FIG. 1, the vacuum scroll pump 1 also has a pump inlet 140 and constituting a vacuum side of the vacuum scroll pump 1 where fluid is drawn into the vacuum scroll pump 1, and a pump outlet 150 and constituting a compression side where fluid is discharged to atmosphere or under pressure from the vacuum scroll pump 1. The inlet opening 270 of the pump head 200 connects the pump inlet 140 to an industrial processing unit 2000, and the exhaust opening 280 leads to the pump outlet 150. Thus, it may be considered that the portion of the vacuum scroll pump 1 from the pump inlet 140 to the inlet opening 270 of the pump head 200 is an inlet portion of the vacuum scroll pump 1, and the portion of the vacuum scroll pump 1 from the exhaust opening 280 to the pump outlet 150 is an exhaust portion of the vacuum scroll pump 1.

As shown in FIG. 1, the inlet opening 270 may be connected to the industrial processing unit 2000, which may be a system or a device in which a vacuum is to be created and/or from which gas is to be discharged. In one embodiment, the industrial processing unit 2000 may comprise a turbomolecular pump whose exhaust is being evacuated by the vacuum scroll pump 1 of the present invention. In another embodiment, the industrial processing unit 2000 is a detector for detecting a tracer gas of a low molecular weight, and the vacuum scroll pump 1 of the present invention draws gas comprising a tracer gas into the detector. In still another embodiment, the industrial processing unit 2000 is a mass spectrometer where for example the vacuum scroll pump 1 of the present invention can draw gas from the differential pressure stages introducing a sample from atmospheric pressure into the interior of the mass spectrometer. In a further embodiment, the industrial processing unit 2000 is a materials deposition system processing a gas stream of reactive gases used for forming a film of material on a substrate inside. In yet another embodiment, the industrial processing unit 2000 is an oven or a vacuum oven where the vacuum scroll pump 1 of the present invention pumps purge gas flowing through the oven. In a different embodiment, the industrial processing unit 2000 is analytical tool such as for example a scanning electron microscope where reduced vibrations are important, and clean roughing pumps for evacuating load locks is important.

Figure 2A:
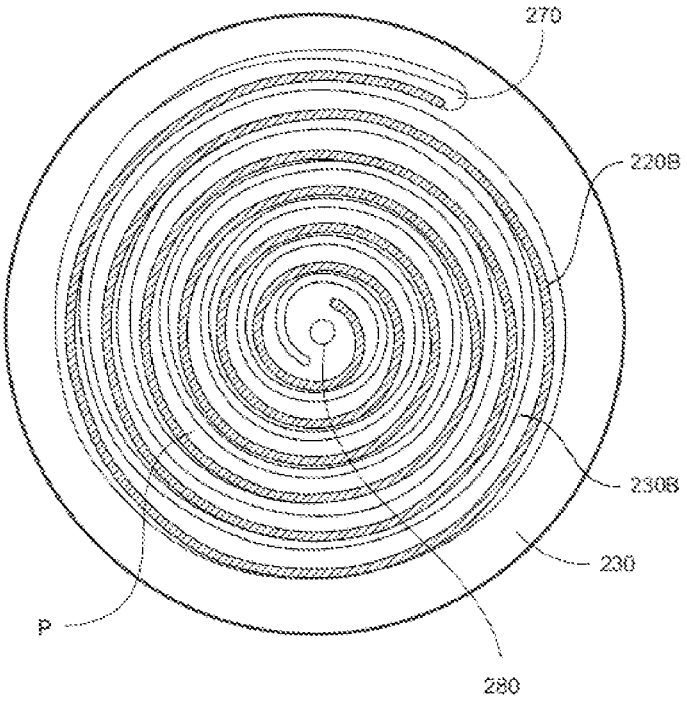
FIG. 2A is a schematic of a nested stationary scroll blade and orbiting scroll blade.
Figure 2B:
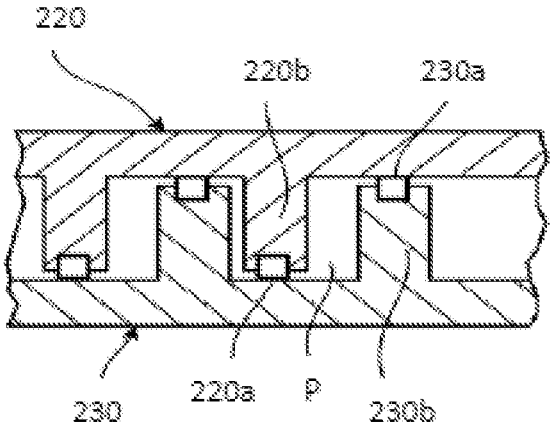
FIG. 2B is a schematic of tip seals for a stationary scroll blade and an orbiting scroll blade.

The vacuum scroll pump 1 includes a stationary scroll blade 220B and orbiting scroll blade 230B which provide the pumping mechanism. As shown in FIG. 2A, the stationary scroll blade 220B and orbiting scroll blade 230B are nested together with a predetermined relative angular and axial positioning such that pockets P (one of which is labeled in FIG. 2A) are delimited by and between the stationary and orbiting scroll blades 220B and 230B during operation of the vacuum scroll pump 1. The pockets P are disposed in series as between the inlet opening 270 and the exhaust opening 280 and collectively constitute the compression stage 260 (FIG. 1) of the vacuum scroll pump 1. Further in this respect, the sides of the scroll blades 220B and 230B may not actually contact each other to seal the pockets P. Rather, minute clearances between sidewall surfaces of the scroll blades 220B and 230B along with tip seals 220A and 230A create seals sufficient for forming satisfactory pockets P. More particularly, FIG. 2B shows a stationary scroll plate 220 and an orbiting scroll plate 230 with one pocket P depicted. FIG. 2B also shows a stationary scroll blade tip seal 220*a* at the end of a stationary scroll blade 220*b* and an orbiting scroll blade tip seal 230*a* at the end of an orbiting scroll blade 230*b*. Accordingly, seals can be provided between the tips of the stationary and orbiting scroll blades 220B and 230B and the opposing front sides of the orbiting and stationary plates, respectively. For these seals to work, the axial location of the stationary and orbiting scroll plates is to be precise to ensure proper sealing and to avoid excessive friction which results in high power draw.

The challenge with a vacuum pump in using oil film bearings is that the oil must be isolated from the working fluid, which typically requires a bellows (such as for example bellows 250, see FIGS. 3A-5) surrounding the drive train. The use of a bellows requires a thrust bearing design capable of taking loads in multiple directions instead of the prior art oil film thrust bearing designs used in scroll compressors which take loads in only one direction.

In order to achieve the highest pumping speed in a vacuum scroll pump, it is necessary to increase the size and displacement of the scroll components. This puts a high load and in particular an overturning moment on the orbiting scroll plate bearings. Typically, the orbiting scroll plate bearing in a vacuum scroll pump consists of two back-to-back angular contact rolling element bearings which take both the radial loads, axial loads, and overturning moment loads, which works well only up to a certain size of pump. In larger scroll pumps, bearing failures are a known reliability issue, and larger components present a noise issue. What is needed is a different bearing architecture which does not use rolling element bearings, such as the oil film bearings used in air conditioning compressors. Yet, even prior art air conditioning scroll compressors have used only a single-sided oil film thrust bearing supporting a thrust load in one direction.

As will become evident from the following description, the embodiments disclosed herein provide a solution to this problem.

Figure 3A:
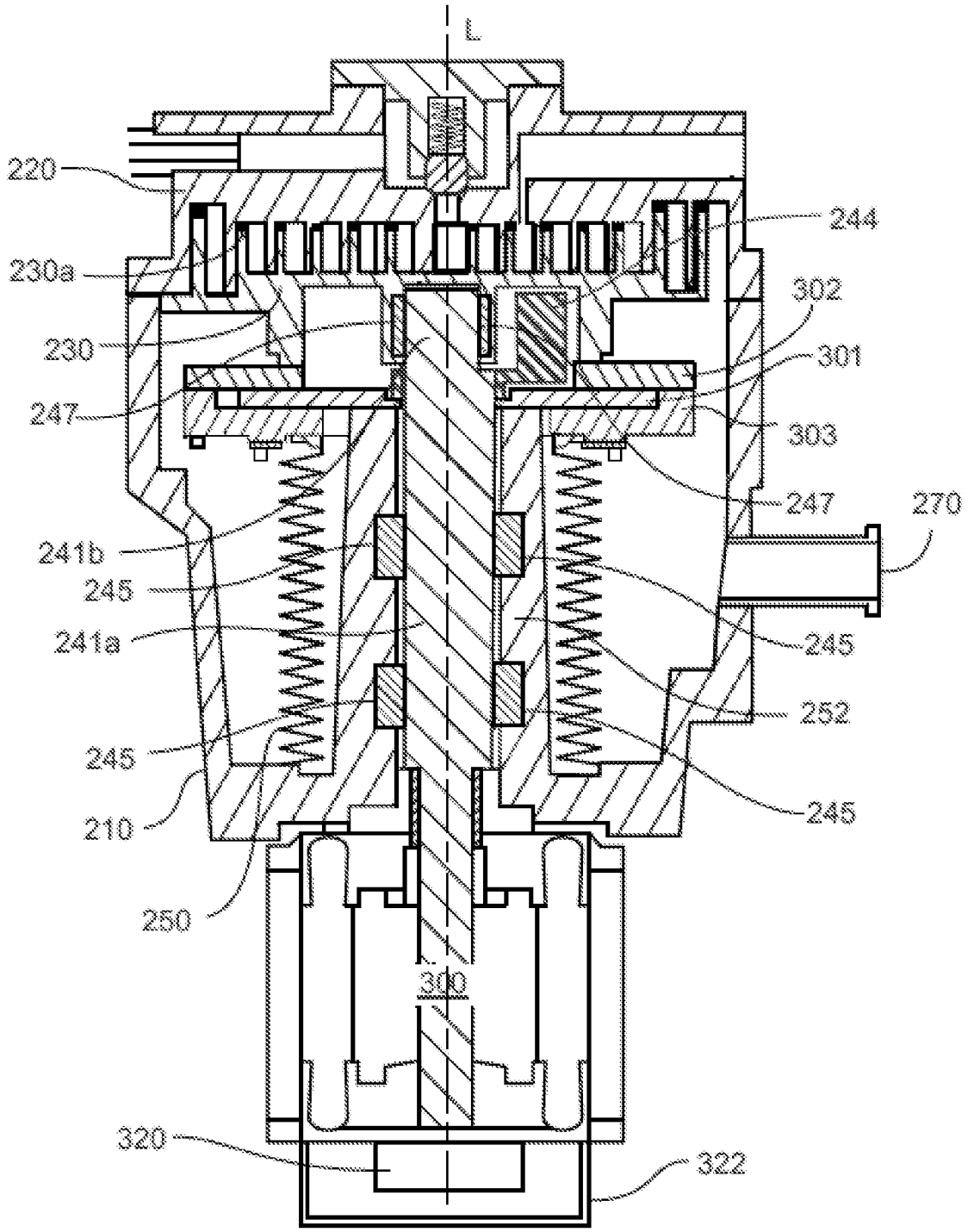
FIG. 3A is a cross-sectional view of the scroll pump including a pump head of the scroll pump showing one embodiment of a double-sided thrust bearing configuration of the present invention.

Referring now to FIG. 3A, a pump head of vacuum scroll pump 1 includes a frame 210, a stationary scroll plate 220, an orbiting scroll plate 230, and a drive mechanism such as for example main shaft 241*a*, eccentric shaft (or crank) 241*b*, and motor 300. The frame 210 may be one unitary piece, or the frame 210 may comprise several integral parts that are fixed to one another.

The stationary scroll plate 220 is detachably mounted to the frame 210 (by fasteners, not shown). The stationary scroll plate 220 includes a stationary plate having a front side and a back side, and a stationary scroll blade 220*b* (FIG. 2B) projecting axially from the front side of the stationary plate. The stationary scroll blade 220*b* is in the form of a spiral having a number of wraps emanating from the axial center of the stationary scroll plate 220, as is known per se (see FIGS. 2A and 2B). The orbiting scroll plate 230 includes an orbiting plate having a front side and a back side, and an orbiting scroll blade 230*b* (FIG. 2B) projecting axially from the front side of the orbiting plate. The orbiting scroll blade 230*b* is in the form of a spiral having a number of wraps or turns emanating from the axial center of the orbiting scroll plate 230 (see FIGS. 2A and 2B). Only the tip seals 230*a* are specifically designated in FIG. 3A.

The main shaft 241*a* is coupled to the motor 300 so as to be rotated by the motor 300 about a longitudinal axis L of the vacuum scroll pump 1. A counterweight 244 is also coupled to the crankshaft (e.g., main shaft 241*a*) to balance the inertial force from the orbiting scroll plate 230.

The main shaft 241*a* is supported by the frame 210 via one or more bearing members 245 so as to be rotatable relative to the frame 210. Bearing members 245 can be hydrodynamic fluid-film journal bearing members, or the bearing members 245 can be rolling element bearing members or other members permitting rotation of the main shaft 241*a* while constraining the main shaft 241*a* from movement away from the longitudinal axis L. The rolling element bearing members can be roller bearings, ball bearings, angular contact bearings, cylindrical rollers, spherical rollers, needle rollers, or any other bearing device where a rolling element is contained between two bearing races, one of which rotates with respect to the other. US Pat. Appl. Publ. No. 2016/0356273 (the entire contents of which are incorporated herein by reference) describes a bearing member arrangement for supporting both the main crank shaft and an eccentric crank at the top. Thus, the orbiting scroll plate 230 is driven by crank 241*b* so as to orbit about the longitudinal axis L of the vacuum scroll pump 1 when the main shaft 241*a* is rotated by the motor 300. At the top of main shaft 241*a* is the eccentric shaft 241*b*, which is offset from the longitudinal axis L. Therefore, when the main shaft 241*a* rotates, the eccentric shaft 241*b* (i.e., a crank) drives the orbiting scroll plate 230 through a hydrodynamic or rolling element bearing 247 in an orbit around the drive shaft axis (i.e. longitudinal axis L), and the orbiting scroll plate 230 moves relative to the stationary scroll plate 220. This movement pushes gas between the scroll blades 220*b* and 230*b* forming a vacuum behind where the gas is pushed out.

As seen in FIG. 3A, a double-sided stationary thrust bearing 301 is fixed to the frame 210 via crankshaft bearing support 252. An upper (or first) orbiting thrust bearing 302 is attached to the orbiting scroll plate 230 and is also attached to a lower (or second) orbiting thrust bearing 303. Therefore, the upper orbiting thrust bearing 302 and the lower orbiting thrust bearing 303 move together with the orbiting scroll plate 230 in an orbit around the drive shaft (main shaft 241*a*) in sliding contact with both sides of the double-sided stationary thrust bearing 301 (dependent on the pump's inlet pressure conditions) During vacuum inlet pressure conditions the orbiting plate is generally forced upwards by the ambient gas pressure inside a bellows 250, whereas in atmospheric inlet pressure conditions the orbiting plate is forced downwards by the high gas compression force in the scroll pockets P shown in FIGS. 2A and 2B. Thus, there is provided a double-sided oil-film thrust bearing with both the top and bottom sides of the double-sided stationary thrust bearing 301 having oil-film sliding surfaces capable of taking loads in either direction. It should be noted that, in typical operation, the oil film is a boundary lubrication and does not necessarily result in a full hydrodynamic oil film separating the sliding pieces of metal. Oil for lubrication of this double-sided oil-film thrust bearing and for the bearing members 245 is provided by oil sump 322 located below or with the motor section 300, as shown in FIG. 3A. The present invention can follow for example similar procedures to those described in US Pat. Appl. Publ. No. 2014/0154116, the entire contents of which are incorporated herein by reference. For example, lubricating oil pumped by an oil pump 320 or centrifugal force can be supplied from an oil sump 322 at the base of the motor 300 to the above-mentioned bearings.

During a normal operation of the vacuum scroll pump 1, a load is applied to the orbiting scroll blade such that the fluid in the pockets P noted above is compressed. The crankshaft (main shaft 241*a* and eccentric shaft 241*b*), as powered by the motor 300, causes the orbiting scroll plate 230 to orbit against this force generated by gas compression about the central longitudinal axis L of the main shaft 241*a*. As shown schematically in FIG. 3B, the compression of the fluid generates a force shown by the arrow to the left which is constrained in one embodiment of the invention by a reactive force represented by the arrow to the right exerted by the eccentric shaft 241*b*. As a result, an overturning moment M (represented by the curved arrow in FIG. 3B) generated by the compression of the fluid and the centrifugal force caused by the orbiting mass of the orbiting scroll plate 230 is reacted by the double-sided stationary thrust bearing 301, along with any axial load from the compression of the fluid and the pressure force from ambient pressure inside the bellows 250.

Figure 3B:
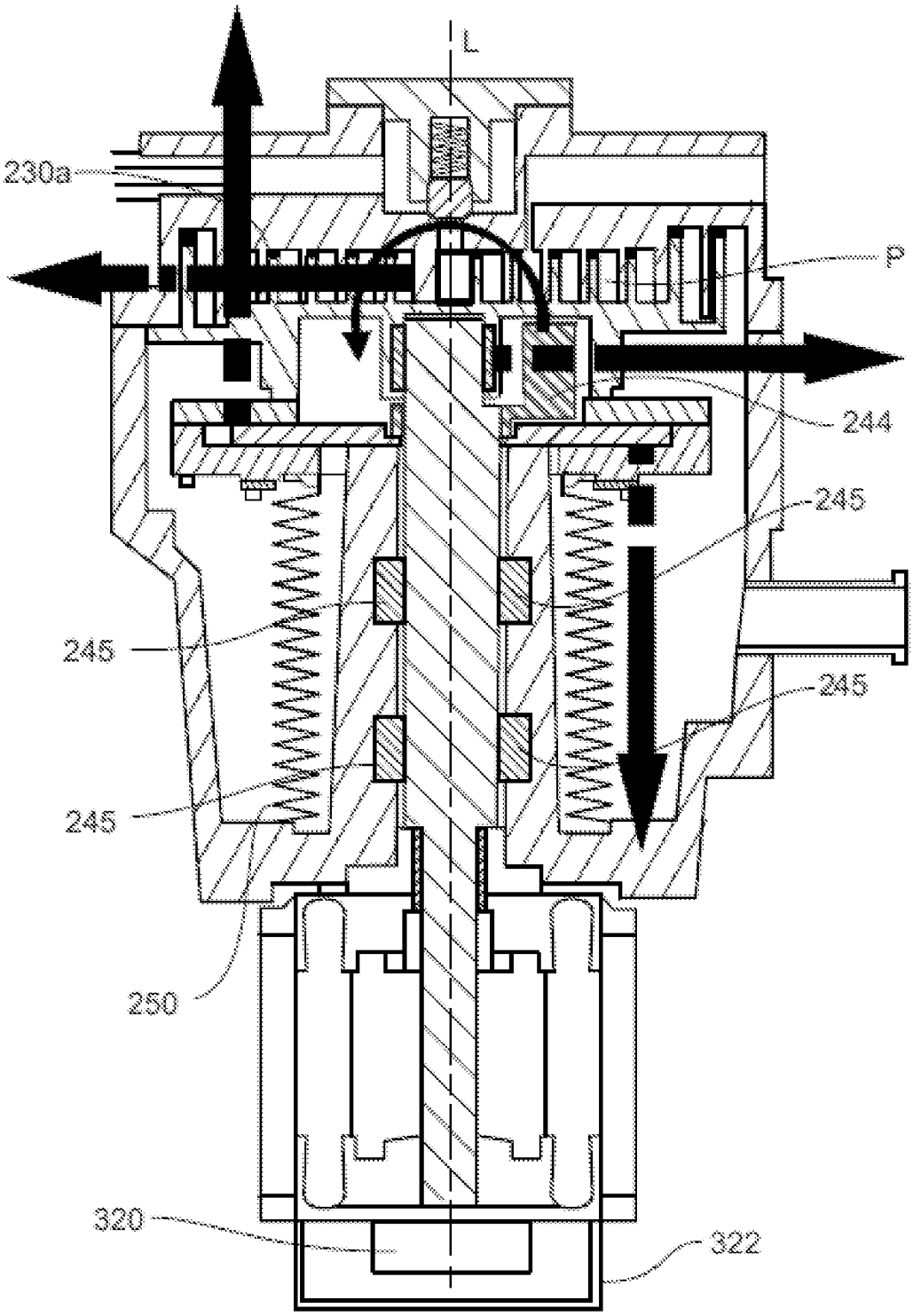
FIG. 3B is a cross-sectional view of the scroll pump of FIG. 3A showing thereon reactive forces and moments.

In more detail, the arrow in FIG. 3B to the left represents the centrifugal force (generated by the orbiting of orbiting scroll plate 230) combined with the compression force noted above. Against this combined force, the arrow to the right represents the reaction force generated by bearing element 247 to balance or counter this force. The result of these two forces (offset from each other axially) is the counterclockwise moment M which would tend to make orbiting scroll plate 230 rotate counterclockwise about an axis extending into the paper (i.e., an overturning moment M). In one embodiment of the invention, the double-sided stationary thrust bearing 301 opposes this overturning moment M. As shown in FIG. 3B, the left side of the double-sided stationary thrust bearing 301 exerts an upward force on the orbiting scroll plate 230 (depicted by the arrow pointed up), while the right side of double-sided stationary thrust bearing 301 exerts a downward force on the orbiting scroll plate 230 (depicted by the arrow pointed down), Additionally, double-sided stationary thrust bearing 301 reacts to vacuum or pressure loading forces on the orbiting scroll plate 230. When the orbiting scroll plate 230 is pumping to form a vacuum relative to the ambient (i.e., relative to the atmospheric pressure in the bellows 250), then the orbiting scroll plate 230 would experience an upward force which would be constrained by the double-sided stationary thrust bearing 301, which is constrained between the upper orbiting thrust bearing 302 and the lower orbiting thrust bearing 303. Similarly, when the pump inlet 140 is at or close to ambient pressure and the orbiting scroll plate 230 is pumping to build pressure relative to the ambient (i.e., relative to the atmospheric pressure in the bellows 250), then the orbiting scroll plate 230 would experience a downward force which would be constrained by the double-sided stationary thrust bearing 301, which is constrained between the upper orbiting thrust bearing 302 and the lower orbiting thrust bearing 303. Accordingly, the double-sided thrust bearing reacts against forces which would result in too little or too much axial clearance under the tip seals 220*a* and 220*b*.

Furthermore, metallic bellows 250 can have a torsional stiffness that prevents the orbiting scroll plate 230 from rotating significantly about the central longitudinal axis of the bellows 250, i.e., from rotating significantly in its circumferential direction.

Figure 4:
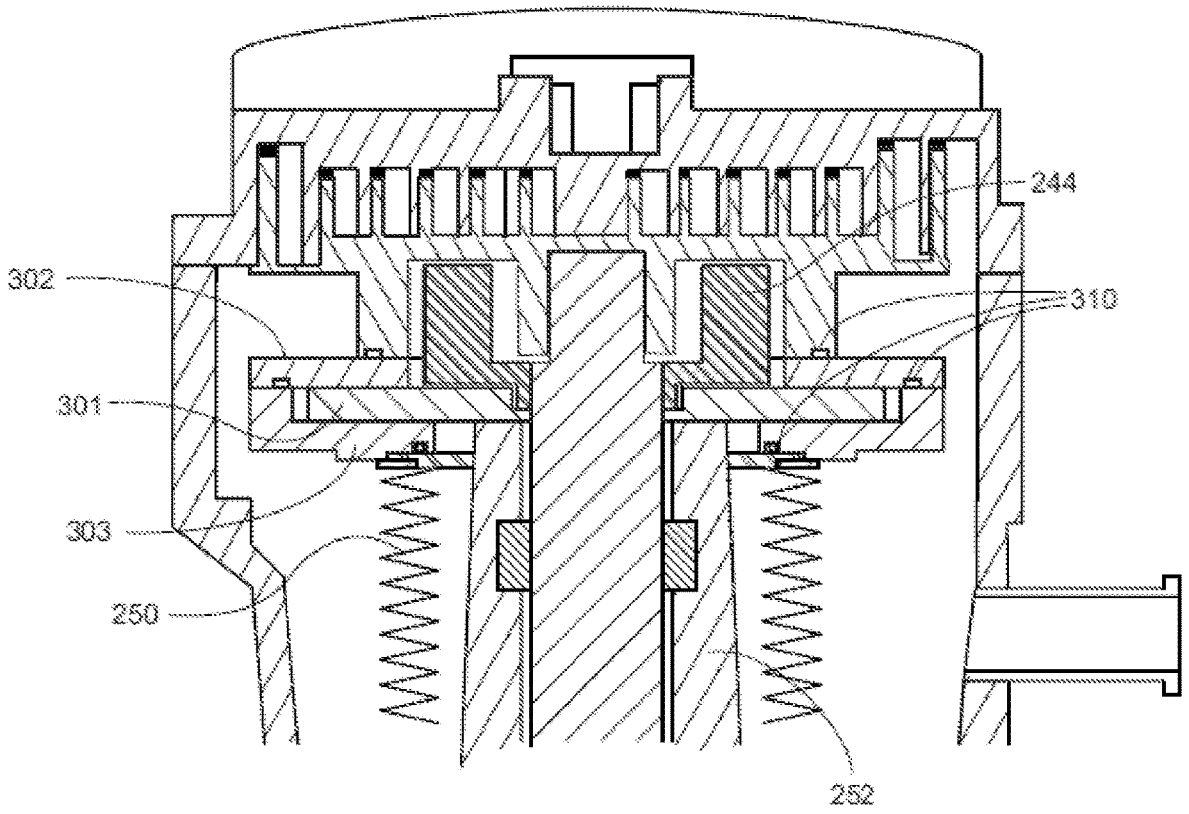
FIG. 4 is a schematic showing exemplary details of an upper orbiting thrust bearing, stationary thrust bearing, and lower orbiting thrust bearing utilized in the present invention.

Accordingly, the overturning or tipping force is constrained in the present invention by double-sided stationary thrust bearing 301, upper orbiting thrust bearing 302, and lower orbiting thrust bearing 303. The double-sided stationary thrust bearing 301 reacts to loads in the vertical downward direction through the upper orbiting thrust bearing 302. Lower orbiting thrust bearing 303 reacts to loads in the vertical upward direction. Furthermore, any overturning moment M or tipping force is constrained by the double-sided stationary thrust bearing 301 being sandwiched between the upper orbiting thrust bearing 302 and lower orbiting thrust bearing 303, as shown in FIGS. 3A-4.

In one embodiment of the invention, this construction with the double-sided stationary thrust bearing 301, the upper orbiting thrust bearing 302, and the lower orbiting thrust bearing 303 forms a double-sided oil film thrust bearing, which is capable of taking loads in both up and down directions as well as reacting to overturning moments M. In one embodiment of the invention, a lubricating film is maintained in the common space between the stationary thrust bearing 301, the upper orbiting thrust bearing 302, and the lower orbiting thrust bearing 303. Together, these plate-like bearing surfaces in contact with each other comprise the sliding surfaces of a double-sided lubricated thrust bearing.

Figure 5:
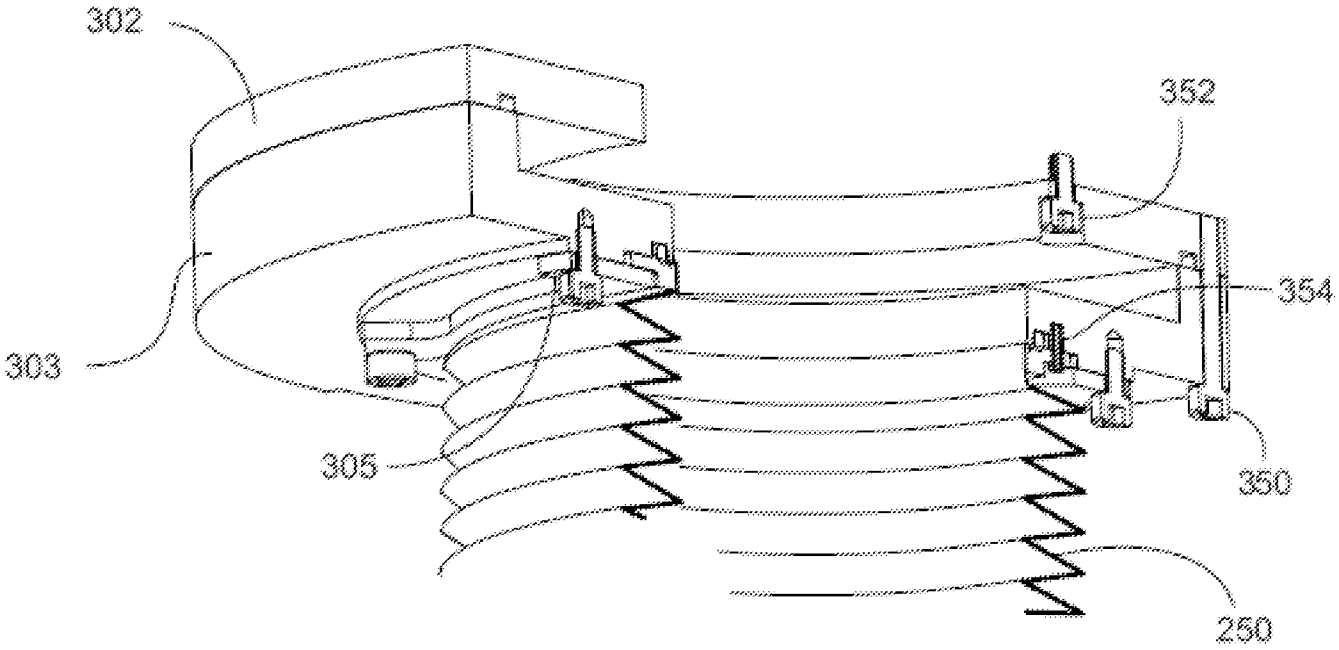
FIG. 5 is a schematic showing detail of a base attachment for a bellows sealing a crank mechanism of the scroll pump.

As shown in FIG. 5, bellows 250 is attached and sealed to the lower orbiting thrust bearing 303 by a bellows attachment 305. Alignment pins 354 are used to clock (angularly set) the position of bellows 250 to the lower orbiting thrust bearing 303, which is likewise precisely clocked to the upper orbiting thrust bearing 302, which is also precisely clocked to the orbiting scroll plate 230. The bellows attachment 305 and the alignment pins 354 serve to prevent the orbiting scroll plate 230 from rotating significantly about the central longitudinal axis of the bellows 250. In addition, the bellows 250 also extends around the drive mechanism (namely, around the main shaft 241*a* and the double-sided stationary thrust bearing 301). In this way, with a static seal 310 (FIG. 4) between the upper orbiting thrust bearing 302 and lower orbiting thrust bearing 303, the bellows 250 seals the double-sided stationary thrust bearing 301 and the double-sided oil film bearing surfaces thereof from the process gas. (Other static seals 310 are shown in FIG. 4 which serve to keep oil in the drive mechanism out of the compression stages of the vacuum scroll pump 1.) FIG. 5 also shows a fastener 350 which attaches the upper orbiting thrust bearing 302 to the lower orbiting thrust bearing 303. FIG. 5 further shows a fastener 352 which attaches the upper orbiting thrust bearing 302 to the orbiting scroll plate 230 (not shown here).

Figure 6:
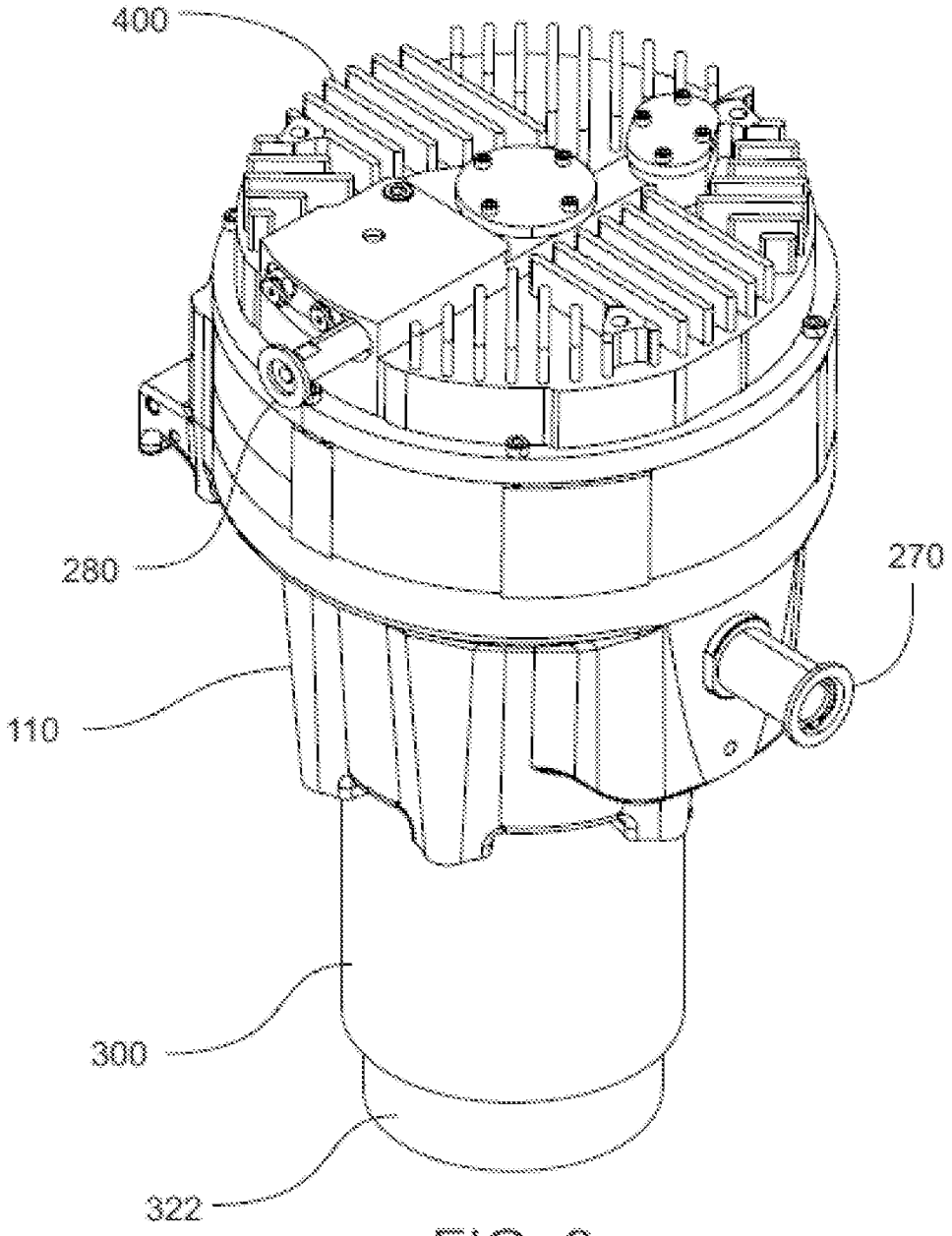
FIG. 6 is an assembly view of the vacuum scroll pump of the present invention.

FIG. 6 is an outside view of the vacuum scroll pump 1 described above.

It will be understood that various aspects or details of the invention may be changed, without departing from the scope of the invention. Furthermore, the foregoing description is for the purpose of illustration only, and not for the purpose of limitation—the invention being defined by the claims.

The invention claimed is:

1. A vacuum scroll pump, comprising:

a pump inlet;

a pump outlet;

a frame;

a stationary scroll plate fixed to the frame and comprising a stationary plate and at least one stationary scroll blade, wherein the at least one stationary scroll blade is spiral-shaped;

an orbiting scroll plate comprising an orbiting plate and at least one orbiting scroll blade projecting axially from the orbiting plate toward the stationary plate, wherein the at least one orbiting scroll blade is spiral-shaped, and wherein the at least one stationary scroll blade and the at least one orbiting scroll blade are nested such that one or more pockets are delimited by and between the at least one stationary scroll blade and the at least one orbiting scroll blade;

a drive mechanism supported by the frame and coupled to the orbiting scroll plate, wherein the drive mechanism is configured to drive the orbiting scroll plate to orbit about a longitudinal axis of the vacuum scroll pump and thereby pump a process gas from the pump inlet to the pump outlet;

a double-sided thrust bearing supporting the orbiting scroll plate, the double-sided thrust bearing configured to react respective axial thrust forces imparted to the orbiting scroll plate in both directions along the longitudinal axis and to react an overturning moment imparted to the orbiting scroll plate, wherein the double-sided thrust bearing comprises a first orbiting thrust bearing, a second orbiting thrust bearing, and a stationary thrust bearing about which the first and second orbiting thrust bearings orbit; and a bellows configured to isolate the process gas from the drive mechanism, wherein the second orbiting thrust bearing is coupled to the bellows.

2. The vacuum scroll pump as claimed in 1, wherein the drive mechanism comprises a crank configured to be turned by a motor and to drive motion of the orbiting scroll plate.

3. The vacuum scroll pump as claimed in claim 1, wherein the first orbiting thrust bearing and the second orbiting thrust bearing are coupled together such that the first orbiting thrust bearing orbits with the second orbiting thrust bearing.

4. The vacuum scroll pump as claimed in claim 1, wherein the double-sided thrust bearing comprises a lubricating film maintained on both sides of the stationary thrust bearing contacting the first orbiting thrust bearing and the second orbiting thrust bearing.

5. The vacuum scroll pump as claimed in claim 1, wherein each of the first stationary thrust bearing, the orbiting thrust bearing, and the second orbiting thrust bearing comprise a plate-like bearing surface.

6. The vacuum scroll pump as claimed in claim 1, wherein the bellows extends around the drive mechanism.

7. The vacuum scroll pump as claimed in claim 1, wherein the bellows comprises a metallic bellows.

8. The vacuum scroll pump as claimed in claim 1, further comprising an oil sump configured to provide a lubricant to the double-sided thrust bearing.

9. The vacuum scroll pump as claimed in claim 1, further comprising at least one bearing member configured to permit rotation of a crank shaft of the drive mechanism while constraining the crank shaft from movement away from the longitudinal axis.

10. The vacuum scroll pump as claimed in claim 9, wherein the bearing member comprises at least one of a fluid-film journal bearing or a rolling element bearing.

11. The vacuum scroll pump as claimed in claim 1, wherein the at least one stationary scroll blade and the at least one orbiting scroll blade have tip seals.

12. The vacuum scroll pump as claimed in claim 1, wherein the double-sided thrust bearing comprises at least two bearing surfaces and is configured to maintain respective lubricating films on the at least two bearing surfaces.

13. The vacuum scroll pump as claimed in claim 1, wherein the bellows comprises respective ends coupled to the double-sided thrust bearing and the frame, respectively.

14. The vacuum scroll pump as claimed in claim 1, wherein the first orbiting thrust bearing is coupled to the orbiting scroll plate and driven to orbit with the orbiting scroll plate.

15. The vacuum scroll pump as claimed in claim 1, wherein the stationary thrust bearing is axially interposed between the first orbiting thrust bearing and the second orbiting thrust bearing, and the first orbiting thrust bearing and the second orbiting thrust bearing are configured to orbit in sliding contact with the stationary thrust bearing.

16. A double-sided thrust bearing for supporting an orbiting scroll plate in a vacuum scroll pump, the double-sided thrust bearing comprising:

a first orbiting thrust bearing configured to connect to the orbiting scroll plate;

a stationary thrust bearing on which the first orbiting thrust bearing orbits during motion of the orbiting scroll plate;

a second orbiting thrust bearing coupled to the first orbiting thrust bearing; and a lubricating film maintained on both sides of the stationary thrust bearing contacting the first orbiting thrust bearing and the second orbiting thrust bearing.

17. The double-sided thrust bearing as claimed in claim 16, wherein the second orbiting thrust bearing is configured to connect to a bellows of the vacuum scroll pump.

18. The double-sided thrust bearing as claimed in claim 16, wherein the stationary thrust bearing, the first orbiting thrust bearing, and the second orbiting thrust bearing each comprise a plate-like bearing surface.

19. The double-sided thrust bearing as claimed in claim 16, wherein the first orbiting thrust bearing is configured to be coupled to the orbiting scroll plate and driven to orbit with the orbiting scroll plate.

* * * * *